US006719642B2

(12) United States Patent
Wahl et al.

(10) Patent No.: US 6,719,642 B2
(45) **Date of Patent: *Apr. 13, 2004**

(54) GOLF CLUB HEAD

(75) Inventors: Bret Wahl, Carlsbad, CA (US); David Anderson, Bloomfield, IL (US); Benoit Vincent, Leucadia, CA (US); Nick Frame, Carlsbad, CA (US); Charles Golden, Encinitas, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/273,584

(22) Filed: Oct. 18, 2002

(65) Prior Publication Data

US 2003/0092507 A1 May 15, 2003

Related U.S. Application Data

(63) Continuation-in-part of application No. 10/057,293, filed on Oct. 19, 2001, now Pat. No. 6,551,200.

(51) Int. Cl.[7] ..... A63B 53/04

(52) U.S. Cl. ..... 473/291; 473/349; 473/350

(58) Field of Search ..... 473/324, 334, 473/335, 336, 337, 338, 339, 349, 350, 345, 256, 292, 290, 291; D21/747, 748, 749, 753, 759

(56) References Cited

U.S. PATENT DOCUMENTS

| | | | | |
|---|---|---|---|---|
| D163,961 S | | 7/1951 | Penna | |
| D164,596 S | | 9/1951 | Penna | |
| D164,597 S | | 9/1951 | Penna | |
| 4,883,275 A | | 11/1989 | Boone | |
| 5,026,056 A | * | 6/1991 | McNally et al. | 473/291 |
| 5,549,297 A | * | 8/1996 | Mahaffey | 473/290 |
| D383,820 S | | 9/1997 | Watanabe | |
| D389,540 S | | 1/1998 | Mendenhall | |
| 5,879,242 A | | 3/1999 | Mendenhall | |
| 6,551,200 B1 | * | 4/2003 | Golden et al. | 473/349 |

FOREIGN PATENT DOCUMENTS

JP 1062791 3/2000

OTHER PUBLICATIONS

Mizuno, '92 Equipment Guide, p. 40.
Daiwa, Daiwa Imagination '93, p. 25.
93 Clubmaking Catalog, Genesis II IRONS, p. 34.
Edwin Watts Golf, Spring 2001, p. 72.
Wilson, Mark, The Golfworks, The Golf Club Identification and Price Guide II, pp. 6–1, 9–21.

* cited by examiner

*Primary Examiner*—Sebastiano Passaniti
(74) *Attorney, Agent, or Firm*—Sheppard, Mullin, Richter & Hampton LLP

(57) ABSTRACT

A set of iron golf clubs is disclosed, each golf club having a head configured to provide enhanced flexibility for launching a golf ball. An upper portion of the body of each head has a reduced stiffness, while a lower portion of the body is configured with recesses that provide reduced stiffness toward the heel and the toe. A low central region supports the head at impact with the golf ball. The relative stiffness in the lower portion of the club head, varying from heel to toe, is designed in conjunction with a top to bottom difference in stiffness. Thus, the golf club head has enhanced flexibility and selectively increased stiffness, for improved performance and feel.

17 Claims, 5 Drawing Sheets

GOLF CLUB HEAD

This is a continuation-in-part of commonly assigned, U.S. application Ser. No. 10/057,293, filed Oct. 19, 2001, now U.S. Pat. No. 6,551,200 and entitled Improved Golf Club Head.

BACKGROUND OF THE INVENTION

The present invention relates generally to iron-type golf clubs and, more particularly, to golf club heads configured to impart improved feel to the golfer and improved transfer of energy to a golf ball.

After the initial drive from a tee, a golfer usually relies upon his or her set of irons to reach the green, where one or more putts typically finish the hole. A set of irons typically includes irons having loft angles ranging from about 17° for low numbered or long irons, through about 50° for higher numbered or short irons, and typically also includes at least a pitching wedge. The increasing loft angles generally cause the golf ball to have a higher launch angle and a higher spin rate. These irons are used primarily for distance down the fairway, as contrasted for example with lob or sand wedges, and therefore are typically designed differently from the higher lofted wedges, which typically have loft angles in the range of about 52 to 60°.

Traditional iron-type golf club heads typically have blade-like shapes, often of a forged steel. This style of head typically includes an upper part that is blade-like and a lower part that is uniformly triangular in cross-section at the rear of the head. The resulting lower mass concentration combines with the loft angle to aid the golfer in getting the club head under the golf ball, particularly in sand or tall grass areas. However, the overall mass distribution can result in a hard feeling upon contact with a golf ball, which is unpleasant to many golfers. Generally, golfers prefer irons having a relatively "soft" feel. They also prefer irons that provide feel feedback on the appropriate swing and contact with the ball, in order to achieve the desired ball travel distance.

Another prior iron-type golf club head design removes some mass from the rear of the head, at both the toe area and the heel area, to create two pockets or recesses. This forms a center peak at the rear of the club head. In one such design, the toe and heel end masses and the center peak extend to an upper position, toward the topline, at the rear of the club head. The increase in thickness of the center peak relative to the upper part of the club head is limited in order not to substantially increase the head's weight. Another prior iron-type golf club design has minimal amounts of mass removed from the toe and/or heel areas, so as to form a cosmetic feature that does not differ substantially from the previous, conventional design. In both recess designs, the higher positioned mass at the rear tends to stiffen the club head.

A currently popular style is a perimeter-weighted, cavity-back iron, which often is made of a cast steel alloy. The perimeter weighting results in a more forgiving structure for mis-hits, and it is preferred by many golfers. Again, however, the perimeter mass can cause sufficient rigidity to result in undesired vibration being felt by the golfer. Such undesired vibrations also can occur even in head designs having a thickened portion at the rear of the head, behind the impact area.

Thus, one undesirable characteristic that is common both to forged, blade-like iron heads and to cast, cavity-back iron heads is a harsh vibration of the head. This vibration also is indicative of uncontrolled energy transfer upon impact with the golf ball. It should, therefore, be appreciated that there is a need for an improved golf club iron head that reduces such undesired vibrations. The present invention fulfills this need.

SUMMARY OF THE INVENTION

The present invention provides an iron-type golf club head providing enhanced flexibility and selectively increased stiffness, for improved performance and feel. That is, the relative stiffness in the lower portion of the club head, varying from heel to toe, is designed in conjunction with a reduced top stiffness that results in improved vibration characteristics. The vibration is an indication of the energy transmission through the club head upon impact with a golf ball. Thus, the present invention optimizes the channeling of the energy that is felt as vibration, or heard as sound, by the golfer by configuring the club head to have discrete stiffened portions. This effect of these discrete stiffened portions has been found to be of greater significance than is the effect of forming the club head of a forged material or a cast material.

A preferred embodiment of a golf club head of the present invention comprises a body having an upper portion and a rearwardly extending lower portion. The upper portion has a top edge, and the lower portion has a bottom edge. The striking face has a length, and a rear side of the lower portion has at least a first recess adjacent a toe end and at least a second recess adjacent a heel end of the head. The loft angle of the club head is between about 17° and 50°.

Preferably, the upper portion of the body tapers such that a first stiffness at its upper end provides a maximum stiffness for the upper portion. A second stiffness at its lower end provides a minimum stiffness for the upper portion.

A lateral axis is defined at the junction between the upper and lower portions of the body, extending from the toe end to the heel end. A reference point is defined at a mid portion of the lateral axis, between about 55% and about 75% of the height of the striking face, as measured from the bottom edge to the top edge. A central axis is defined substantially parallel to the lateral axis, at approximately 50% of the face height.

The first recess comprises a first volume and the second recess comprises a second volume, and the first and second recesses extend at least to the central axis. The portions of the body that define the first and second recesses preferably each have a stiffness no more than 90% greater than a minimum stiffness of the upper portion. The remainder of the lower portion preferably has a stiffness at least 230% greater than the stiffness of at least one of the first and second recesses.

In the preferred embodiment, the central region of the lower portion, located below the reference point, has a maximum stiffness that is at least about 30 times a maximum stiffness of the upper portion. The regions below the first and second recesses each have a maximum stiffness at least about 20 times the maximum stiffness of the upper portion. A stiffness zone is defined within the central region, at the central axis, and it extends halfway toward the lateral axis, between the first and second recesses. The zone extends at least about 20% of the length of the striking face, such that a relative stiffness is established between the central region and the upper portion and between the central region and the first and second recesses.

Other features and advantages of the present invention should become apparent from the following description of the preferred embodiment, taken in conjunction with the accompanying drawings, which illustrate, by way of example, the principles of the invention.

DETAILED DESCRIPTION OF THE PREFERRED EMBODIMENTS

Figure 1:
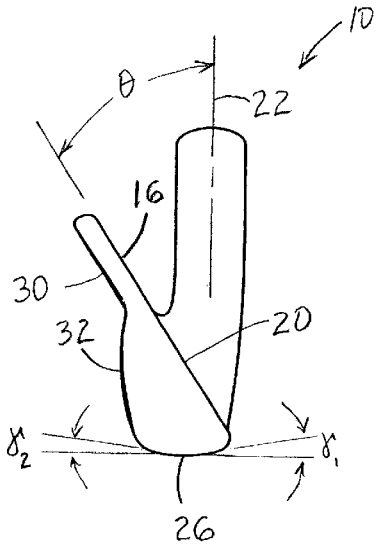
FIG. 1 is a side elevational view of a golf club head of a preferred embodiment of the invention, taken from the toe end.

With reference now to the illustrative drawings, and particularly to FIGS. 1–5, there is shown an iron-type golf club head 10 having a cast metal body with a top edge 12 and a bottom edge 14 at its front wall 16. A scoreline pattern 18 at a front striking face 20 of the front wall may have the form of U-shaped grooves or any other groove shape desired to obtain a preferred spin rate for a golf ball (not shown) upon impact with the striking face. The striking face has a length $L_F$, measured from a point of intersection of a shaft axis 22 with a plane supporting the club head to the widest point at the club head's toe end 24.

The present invention can be embodied in long and mid irons (e.g., #1–4 and #5–7) having loft angles θ ranging from about 17° to about 38°, as well as in short irons (e.g., #8–9) having loft angles θ ranging to about 45°, and also in wedges having loft angles up to about 50°. A sole 26 may have one or more bounce angles $\gamma_i$, as desired, to effect ground interaction during a stroke. The golf club iron preferably is part of a set including at least two clubs, and more preferably including at least a #3 iron through a pitching wedge.

Figure 2:
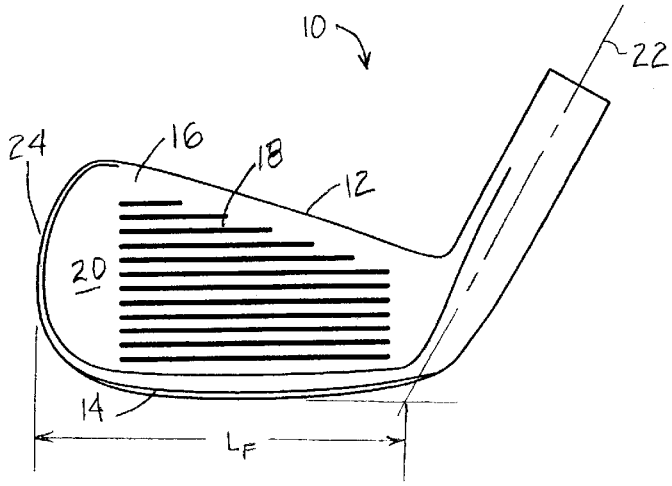
FIG. 2 is a front elevational view of the golf club head of FIG. 1, showing a striking face having scorelines.
Figure 3:
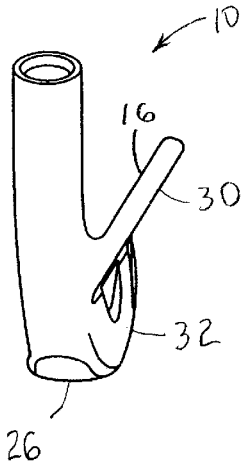
FIG. 3 is a side elevational view of the golf club head of FIG. 1, taken from the heel end.
Figure 4:
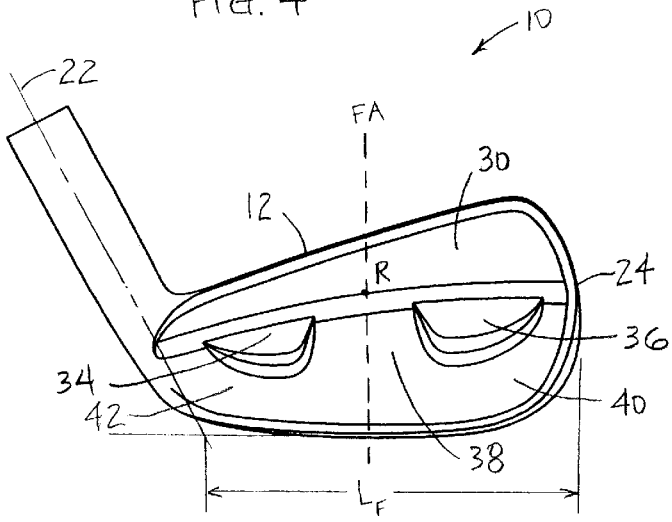
FIG. 4 is a rear elevational view of the golf club head of FIG. 1.

FIGS. 2 and 4 show how the flexibility of the club head 10 is enhanced by configuring it to have a relatively thin upper portion 30 and a relatively thick lower portion 32, with recesses 34, 36 positioned on opposite sides of a central region 38. Generally, the rear mass of the club head is specifically located to obtain discrete stiffened portions across a toe region 40, the central region 38, and a heel region 42. In the first embodiment described below, these discrete stiffness regions are achieved using specific tailored thicknesses. In contrast, prior art iron designs typically have been configured to have either a blade-like shape or a cavity-back, perimeter-weighted shape.

The present invention optimizes the channeling of the energy that is sensed as vibration or sound by the golfer by use of the discrete stiffened portions. This effect of these discrete stiffened portions has been found to be of greater significance than is the effect of forming the club head of a forged material or a cast material.

Figure 5:
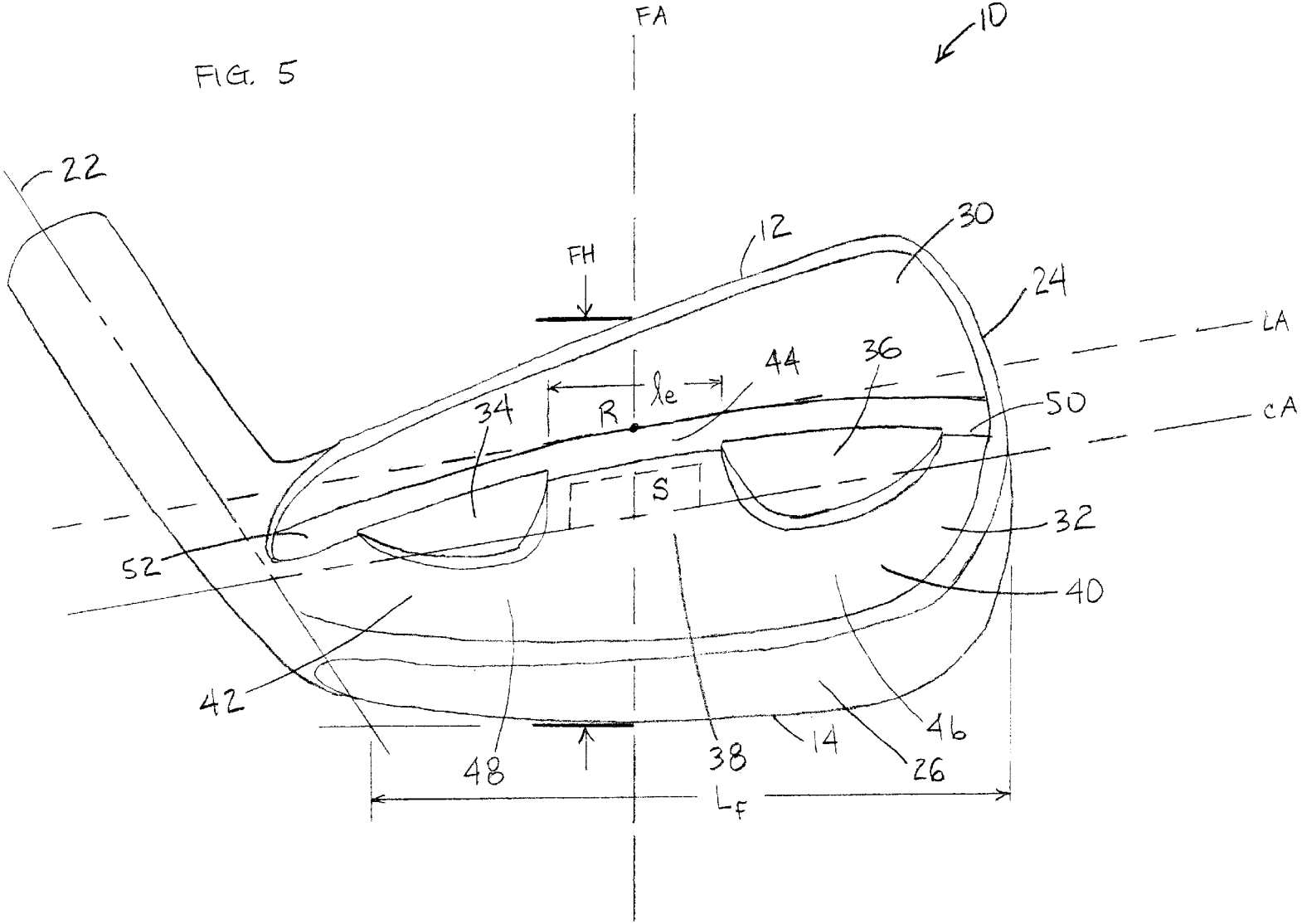
FIG. 5 is a rear view of the golf club head of FIG. 1, taken in a direction substantially perpendicular to the club head's rear face and showing regions of enhanced flexibility and regions of increased stiffness.

As shown in FIG. 5, a face axis FA is defined at the middle of the central region 38, within about 10–15% of the midpoint of the length of the face $L_F$. The region immediately adjacent to the face axis generally corresponds to the "sweet spot" of the club head 10. A lateral axis LA is defined to be substantially tangent to, or linearly overlaying, the junction between the club head's upper and lower portions 30, 32. This junction is depicted in FIG. 5 to curve downwardly, but it can alternatively curve upwardly or form a straight line. A reference point R is defined where the face axis FA intersects the lateral axis LA.

A reference face height FH is measured along the face axis FA, from the bottom edge 14 to the top edge 12 of the club head 10, generally parallel to the plane formed by the front striking face 20. A central axis CA is defined at the middle of the face height FH, parallel with the lateral axis LA. The reference point R preferably is located at a point between 55% and 75%, and more preferably between about 60% and 70%, of the way from the bottom edge to the top edge. Table I sets forth the loft angle and height of R for an exemplary set of irons of the first preferred embodiment.

TABLE I

First Preferred Embodiment Loft vs. R Values

| Iron No. | 3 | 4 | 5 | 6 | 7 | 8 | 9 | PW |
|---|---|---|---|---|---|---|---|---|
| Loft (deg) | 21 | 24 | 28 | 32 | 36 | 40 | 44 | 48 |
| Ht of R (% FH) | 64 | 65 | 65 | 67 | 69 | 61 | 64 | 66 |

The recesses 34, 36 are configured to provide significantly improved flexibility in the respective toe and heel regions 40, 42, by their specific location and size at the rear of the club head 10. A top end 44 of the central region 38 has a width $l_c$, as measured along the lateral axis LA, that is between about 5% and 45% of the face length $L_F$, or more preferably between about 25% and 35% of $L_F$. The recesses 34, 36 preferably are bound laterally at the toe and heel ends by ribs 46, 48 that extend beneath the recesses, above the sole 26. The upper ends 50, 52 of the ribs 46, 48 may lie generally along the lateral axis LA. Alternatively, one or both of the upper ends of the ribs may lie below or above the lateral axis, LA. Preferably, neither rib extends beyond about 75% of the face height FH at the toe and heel ends, and both ribs have a height measured above the sole that is at least 10% of the face height FH.

With continued reference to FIG. 5, a stiffness zone S is defined in a section of the central region 38, extending in a vertical direction from the central axis CA about midway to the lateral axis LA. In a substantially normal direction, the stiffness zone S preferably extends a distance of at least 10%, and more preferably at least 20%, of the face length $L_F$, as measured from the face axis FA toward the toe and heel ends. As shown, the stiffness zone S is rectangular and does not include any portion of either recess. The stiffness zone S provides substantially increased stiffness relative to the upper portion 30.

In alternative embodiments of the invention (not shown in the drawings), the top end 44 of the central region 38, with the reference point R, is curved above the stiffness zone S. Alternatively, the top end can extend toward the toe and heel regions 40, 42, over the recesses 34, 36. In other embodiments, multiple recesses can be formed at the toe and heel regions. In these latter embodiments, the overall lateral extent of the recesses is greater than it is in the earlier described embodiment, while the central region 38 has a narrower lateral extent $l_c$ at the junction of the upper and lower portions 30, 32.

The volumes of the recesses 34, 36 can be measured in terms of the material removed from an equivalent body without such recesses. In the present invention, the recesses extend downwardly from approximately the junction of the upper and lower portions 30, 32 to at least the central axis CA. The shape of the recesses can vary from that depicted in FIG. 4, and can be, for example, rectangular, circular, triangular, or oval.

Elaborating now on the stiffness characteristics of the present invention, a point on a wall of the club head 10 may be considered beam-like in cross-section, and its bending stiffness at that point can be calculated as a cubed function of its thickness, $h^3$. That is, $EI=f(h^3)$, where E is the Young's Modulus and I is the inertia of the cross-section. Thus, for a body of uniform material, if a first point on the body has a thickness of 4.5 mm and a second point has a thickness of 5 mm, then the second point is 11% thicker and has a stiffness that is about 37% greater than that of the first point:

$$(5)^3/(45)^3=(1.11)^3=1.37$$

Figure 6:
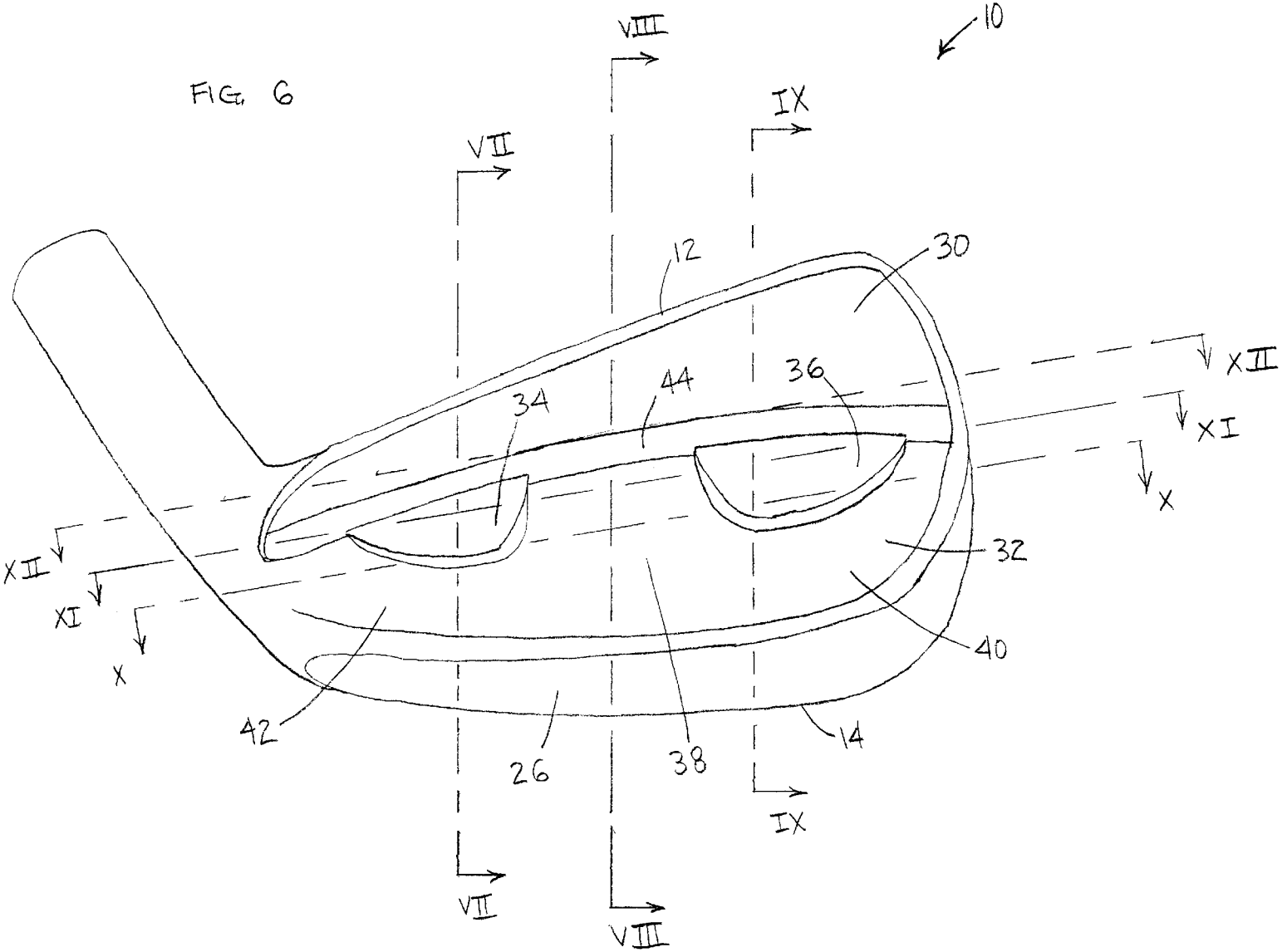
FIG. 6 is the same as FIG. 5, but show the locations of detailed cross-sections.

Referring now to FIGS. 4–6, a small stepped increase in thickness from the upper portion 30 is present at the lower portion 32, including the recesses 34, 36. This increase does not increase the stiffness at the recesses by more than about 90% compared to the stiffness at the upper portion. The recesses are open toward the upper portion, because there is no wall bounding either recess at the junction of the upper and lower portions of the club head where the stepped increase occurs.

Figure 9:
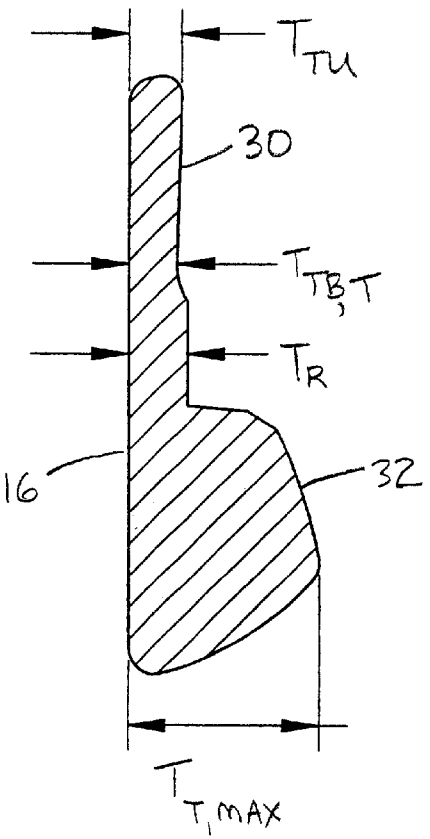
FIG. 9 is a cross-sectional view of the golf club head of FIG. 6, taken at line IX—IX, in the toe region.
Figure 8:
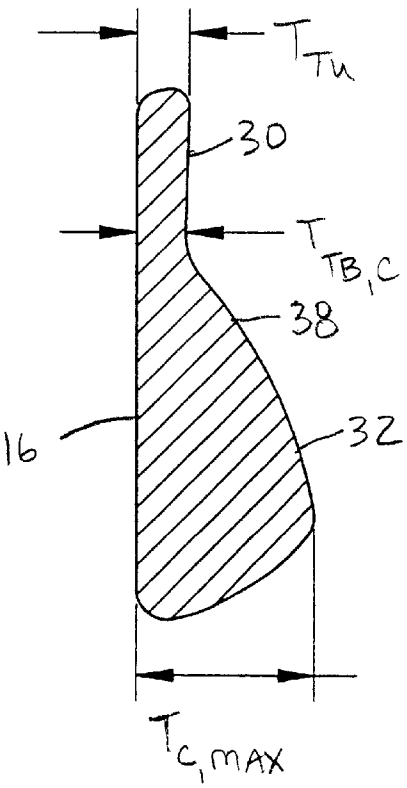
FIG. 8 is a cross-sectional view of the golf club head of FIG. 6, taken at line VIII—VIII, in the central region.
Figure 7:
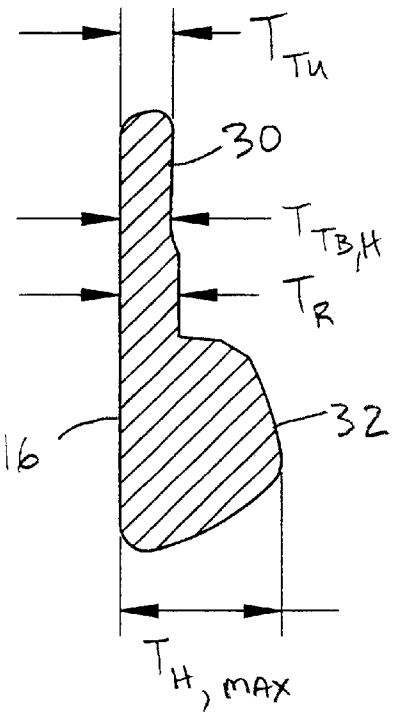
FIG. 7 is a cross-sectional view of the golf club head of FIG. 6, taken at line VII—VII, in the heel region.
Figure 10:
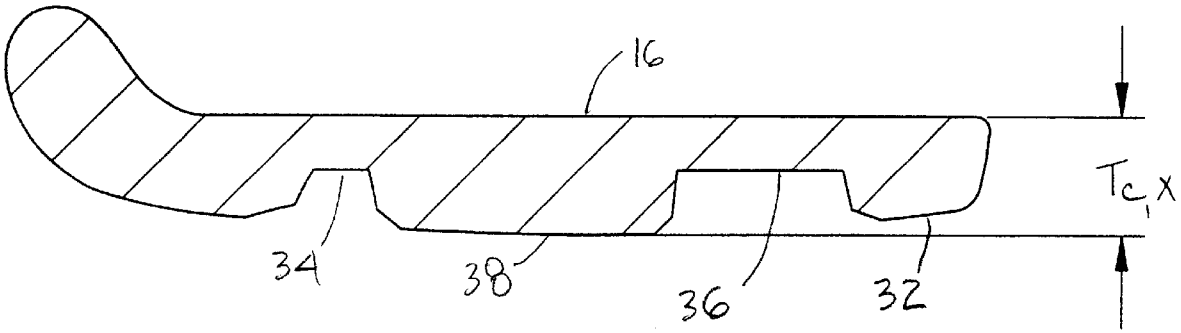
FIG. 10 is a cross-sectional view of the golf club head of FIG. 6, taken at line X—X, in the lower portion of the club head containing the lower ends of the recesses.
Figure 11:
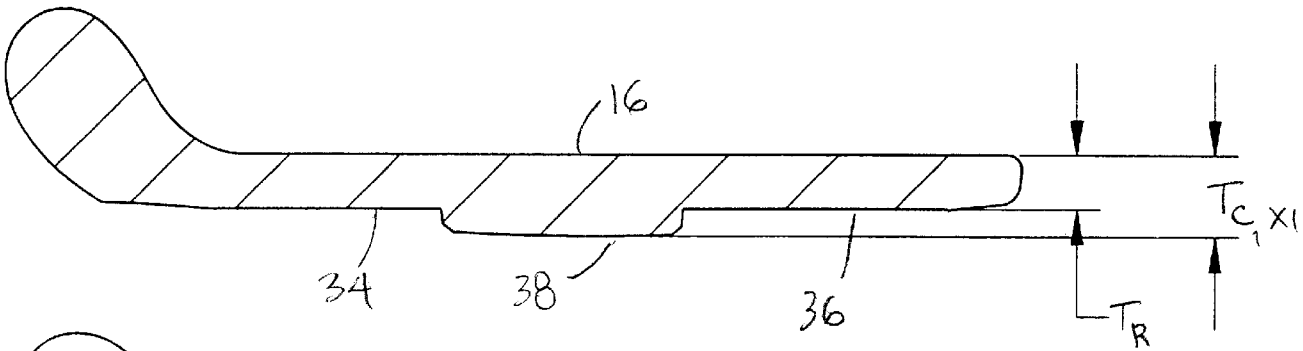
FIG. 11 is a cross-sectional view of the golf club head of FIG. 6, taken at line XI—XI, in the lower portion containing the recesses.
Figure 12:
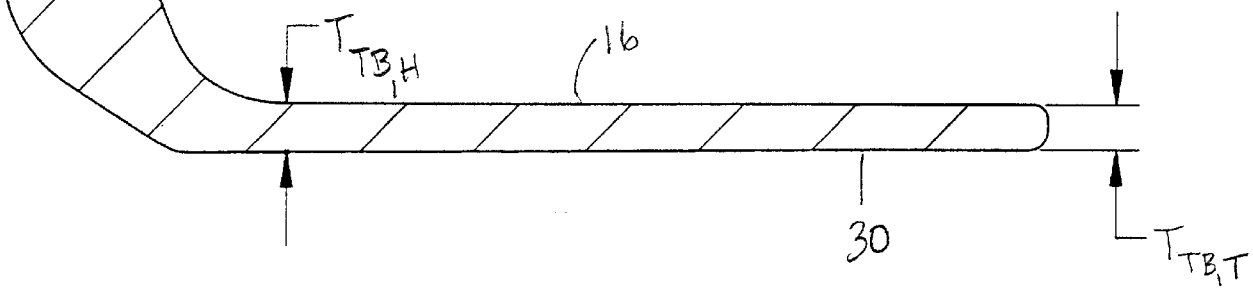
FIG. 12 is a cross-sectional view of the golf club head of FIG. 6, taken at line XII—XII, at about the junction of the upper and lower portions.

FIGS. 7–9 are cross-sectional views of the club head 10 taken generally vertically at the heel region 42, the central region 38, and the toe region 40, respectively. FIGS. 10–12 are cross-sectional views of the club head taken generally horizontally at three distinct horizontal positions. These views show the changes in thickness, and thus indicate the changes in stiffness, from top to bottom and from heel to toe. A thickness $T_{TU}$ at an upper end of the club head's upper portion 30 preferably is in the range of about 3 mm to about 6 mm, and more preferably is in the range of 4 mm to 5 mm, and most preferably is about 4.5 mm. In addition, the thickness $T_{TU}$ preferably is constant for all of the irons in the set. The upper portion 30 preferably tapers downwardly toward the lower portion 32, from a thickness $T_{TU}$ at its upper end to a thickness $T_{TB}$ at its lower end. Preferably, the thickness $T_{TU}$ is less than about 10% greater than the thickness $T_{TB}$. Because the head height increases heel to toe, the thickness $T_{TB}$ at the lower end of the upper portion 30 has decreasing values from heel to toe. In alternative embodiments, the thickness $T_{TU}$ could vary through the set.

In the present invention, the thickness of the front wall 16 at the location of the recesses 34, 36 is slightly increased from the upper end of the upper portion 30 of the club head 10. In this first embodiment, the recess wall thickness $T_R$ at the heel and toe is the same and is about 5 mm, or less than about 12% greater than the upper end thickness $T_{TU}$. Neither recess 34, 36 should have a wall thickness that is more than about 25% greater than either the thickness $T_{TU}$ or the thickness $T_{TB}$.

The remainder of the lower portion 32 of the club head 10 preferably has a thickness that is at least 25% greater than the thickness $T_{TU}$ This corresponds to a stiffness increase at least 95%. Preferably, the thickness of this remainder of the lower portion is at least 50% greater than the thickness $T_{TU}$, which corresponds to stiffness increase of at least 230%.

In addition, a point of maximum thickness $T_{C,MAX}$ in the central region 38 (see FIG. 8) is at least 3 times thicker than the thickness $T_{TU}$. This increases the stiffness by a factor of at least 27. More preferably, the maximum thickness $T_{C,MAX}$ is selected to increase the stiffness by a factor of at least 30 times. Similarly, points of maximum thickness $T_{T,MAX}$, $T_{H,MAX}$ in the respective toe and heel regions 40, 42 are at least 2.5 times thicker than the thickness $T_{TU}$, providing a stiffness increase by a factor of at least 15 times. Preferably, the central, toe and heel regions all are at least 20 times stiffer than the upper portion 30. The preferred thickness values for a 6-iron of this embodiment are shown in Table II.

TABLE II

First Preferred Embodiment Thickness/Stiffness Values for 6 Iron

| REGION | UPPER PORTION $T_{TU}$, $T_{TB,MIN}$ | RECESS $T_R$ | TOE $T_{T,MAX}$ | CENTRAL $T_{C,MAX}$ | HEEL $T_{H,MAX}$ |
|---|---|---|---|---|---|
| Thickness (mm) | 4.5, 4.1 | 5 | 16.3 | 15.4 | 13.6 |
| Relative Stiffness ($T^3$) | 91.1, 68.9 | 125 | 4331 | 3652 | 2515 |
| Δ Stiffness (%) | — | +37, +81 | +4654, +6186 | +3909, +5200 | +2661, +3550 |

A preferred material for the club head 10 of the present invention is steel, and more preferably a carbon steel such as 8620 or 1025. Alternative materials also could be used, including other metals and alloys, composites, and hybrid constructions utilizing, for example, laminations of metal and composite materials. If the club head is cast of a metal material such as steel, the recesses can be formed by milling. Alternatively, the front wall 16 and front striking face can be a separate portion that is welded or otherwise attached to the remainder of the club head in a manner known to those skilled in the art. The lower rear portion of the club head can include one or more separately formed pieces that are attached to the front in any manner known to those skilled in the art.

Although the invention has been disclosed in detail with reference only to the preferred embodiments, those skilled in the art will appreciate that additional golf club heads can be made without departing from the scope of the invention. Accordingly, the invention is defined only by the claims set forth below.

We claim:

1. A golf club head comprising:

a body including an upper portion having a top edge and a rearwardly extending lower portion having a bottom edge, wherein said upper and lower portions together form a substantially planar striking face having a loft angle between about 17° and 50°, as measured from a vertical axis, said striking face having a length, and wherein a rear side of said lower portion has at least a first recess adjacent a toe end and at least a second recess adjacent a heel end;

wherein a lateral axis is defined at the junction between said upper and lower portions of said body, extending from said toe end to said heel end, with a reference point being defined at a mid portion of said lateral axis, between about 55% and about 75% of the height of the striking face, as measured from said bottom edge to said top edge, and wherein a central axis is defined substantially parallel to said lateral axis, at about 50% of the face height;

wherein said first recess comprises a first volume and said second recess comprises a second volume, said first and second recesses extending downwardly at least to said central axis, and wherein the portions of the body that define said first and second recesses each have a stiffness no more than 90% greater than a minimum stiffness of said upper portion, while the remainder of said lower portion has a stiffness at least 230% greater than the stiffness at each of the first and second recesses;

wherein a central region of said lower portion, located below said reference point, has a maximum stiffness that is at least about 30 times a maximum stiffness of said upper portion, wherein regions below said first and second recesses each have a maximum stiffness at least about 20 times the maximum stiffness of said upper portion, wherein a stiffness zone is located within said central region, at said central axis and extending half-way toward said lateral axis and, between said first and second recesses, at least about 20% of the length of said striking face, such that a relative stiffness is established between said central region and said upper portion and between said central region and said first and second recesses.

2. The golf club head of claim 1, wherein:

said upper portion has an upper thickness having a first stiffness and a lower thickness having a second stiffness; and the portions of the body that define said first and second recesses of said lower portion each have a stiffness no more than 50% greater than said first stiffness of said upper portion and no more than 90% greater than said second stiffness of said upper portion.

3. The golf club head of claim 1, wherein said upper portion of the body tapers such that said first stiffness is said maximum stiffness of said upper portion and said second stiffness is said minimum stiffness of said upper portion.

4. The golf club head of claim 1, wherein the portions of the body that define said first and second recesses each have a thickness less than 25% greater than any thickness of said upper portion.

5. The golf club head of claim 1, wherein said upper portion of the body tapers such that it has an upper thickness and a lower thickness, said upper thickness being less than 10% greater than said lower thickness.

6. The golf club head of claim 1, wherein the thickness of said upper portion is between about 3 mm and about 6 mm.

7. The golf club head of claim 6, wherein the thickness of said upper portion is between about 4 mm and about 5 mm.

8. The golf club head of claim 1, wherein said junction between said upper and lower portions of said body is curved and said lateral axis is tangent to said junction at said reference point.

9. A set of at least two iron golf clubs, each golf club having a head comprising:

a body including an upper portion having a top edge and a rearwardly extending lower portion having a bottom edge, wherein upper and lower portions together form a substantially planar striking face having a loft angle between about 20° and 50°, as measured from a vertical axis, said striking face having a length, and wherein a rear side of said lower portion has at least a first recess adjacent a toe end and at least a second recess adjacent a heel end;

wherein a lateral axis is defined at the junction between said upper and lower portions of said body, extending from said toe end to said heel end, with a reference point being defined at a mid portion of said lateral axis, between about 55% and about 75% of the height of the striking face, as measured from said bottom edge to said top edge, and wherein a central axis is defined substantially parallel to said lateral axis, at about 50% of the face height;

wherein said first recess comprises a first volume and said second recess comprises a second volume, said first and second recesses extending downwardly at least to said central axis, and wherein the portions of the body that define said first and second recesses each have a stiffness no more than 90% greater than a minimum stiffness of said upper portion, while the remainder of said lower portion has a stiffness at least 230% greater than the stiffness at each of the first and second recesses;

wherein a central region of said lower portion, located below said reference point, has a maximum stiffness that is at least about 30 times a maximum stiffness of said upper portion, wherein regions below said first and second recesses each have a maximum stiffness at least about 20 times the maximum stiffness of said upper portion, wherein a stiffness zone is located within said central region, at said central axis and extending half-way toward said lateral axis and, between said first and second recesses, at least about 10% of the length of said striking face, such that a relative stiffness is established between said central region and said upper portion and between said central region and said first and second recesses;

wherein each golf club in the set has a unique loft angle.

10. The set of claim 9, wherein:

said upper portion of each club head body has an upper thickness having a first stiffness and a lower thickness having a second stiffness; and the portions of the body that define said first and second recesses of said lower portion each have a stiffness no more than 50% greater than said first stiffness of said upper portion and no more than 90% greater than said second stiffness of said upper portion.

11. The set of claim 9, wherein the portions of each club head body that define said first and second recesses each have a thickness less than about 25% greater than any thickness of said upper portion.

12. The set of claim 9, wherein said upper portion of each club head body tapers such that it has an upper thickness and a lower thickness, said upper thickness less than about 10% greater than said lower thickness.

13. A golf club head comprising:

a body including an upper portion having a top edge and a rearwardly extending lower portion having a bottom edge, wherein said upper and lower portions together form a substantially planar striking face having a loft angle between about 17° and about 50°, as measured from a vertical axis, said striking face having a length, and wherein a rear side of said lower portion has at least a first recess adjacent a toe;

wherein a lateral axis is defined at the junction between said upper and lower portions of said body, extending from said toe end to a heel end, with a reference point being defined at a mid portion of said lateral axis, between about 55% and about 75% of the height of the striking face, as measured from said bottom edge to said top edge, and wherein a central axis is defined substantially parallel to said lateral axis, at approximately 50% of the face height;

wherein said first recess comprises a first volume and extends downwardly at least to said central axis, and wherein the portion of the body that defines said first recess has a stiffness no more than 90% greater than a minimum stiffness of said upper portion, while the remainder of said lower portion has a stiffness at least 230% greater than the stiffness at the first recess;

wherein a central region of said lower portion, located below said reference point, has a maximum stiffness that is at least about 30 times a maximum stiffness of said upper portion, wherein the region below said first recess has a maximum stiffness at least about 20 times the maximum stiffness of said upper portion, wherein a stiffness zone is located within said central region, at said central axis and extending halfway toward said lateral axis and, adjacent said first recess at least about 20% of the length of said striking face, such that a relative stiffness is established between said central region and said upper portion and between said central region and said first recess.

14. The golf club head of claim 13, wherein:

said upper portion has an upper thickness having a first stiffness and a lower thickness having a second stiffness, and the portion of the body that defines said first recess of said lower portion has a stiffness no more than 90% greater than said first and second stillnesses of said upper portion.

15. The golf club head of claim 13, wherein said first stiffness of said upper portion is substantially the same as said second stiffness of said upper portion.

16. The golf club head of claim 13, wherein the portion of the body that defines said first recess has a thickness less than 25% greater than any thickness of said upper portion.

17. The golf club head of claim 13, wherein said upper portion of the body tapers such that it has an upper thickness and a lower thickness, said upper thickness less than 10% greater than said lower thickness.

* * * * *

UNITED STATES PATENT AND TRADEMARK OFFICE

CERTIFICATE OF CORRECTION

PATENT NO. : 6,719,642 B2
DATED : April 13, 2002
INVENTOR(S) : Bret Wahl et al.

It is certified that error appears in the above-identified patent and that said Letters Patent is hereby corrected as shown below:

Column 10,
Line 11, change “stillnesses” to -- stiffnesses --

Signed and Sealed this

First Day of June, 2004

JON W. DUDAS
*Acting Director of the United States Patent and Trademark Office*